US007863549B2

(12) United States Patent
Song et al.

(10) Patent No.: US 7,863,549 B2
(45) Date of Patent: Jan. 4, 2011

(54) MICROWAVE RANGE HAVING HOOD

(75) Inventors: Sung Bae Song, Gyeonggi-do (KR); Sang Bum Sohn, Seoul (KR); Jong Sik Kim, Seoul (KR)

(73) Assignee: LG Electronics Inc., Seoul (KR)

( * ) Notice: Subject to any disclaimer, the term of this patent is extended or adjusted under 35 U.S.C. 154(b) by 258 days.

(21) Appl. No.: 11/968,267

(22) Filed: Jan. 2, 2008

(65) Prior Publication Data

US 2008/0156795 A1 Jul. 3, 2008

(30) Foreign Application Priority Data

Jan. 2, 2007 (KR) ..... 10-2007-0000138

(51) Int. Cl.
*H05B 6/64* (2006.01)
*F24C 15/20* (2006.01)
*F24C 15/32* (2006.01)

(52) U.S. Cl. ..... 219/757; 126/299 R; 126/21 R

(58) Field of Classification Search ..... 219/756–758, 219/735, 681, 391; 415/119; 126/21 A, 126/21 R, 299 D
See application file for complete search history.

(56) References Cited

U.S. PATENT DOCUMENTS

| | | | | |
|---|---|---|---|---|
| 5,951,907 | A * | 9/1999 | Kang | 219/757 |
| 6,864,472 | B2 | 3/2005 | Kang | |
| 7,135,663 | B2 | 11/2006 | Kang | |
| 2003/0218011 | A1 * | 11/2003 | Jeong | 219/757 |
| 2004/0079751 | A1 | 4/2004 | Kim et al. | |
| 2004/0262303 | A1 | 12/2004 | Kang | |
| 2005/0011887 | A1 * | 1/2005 | Kim | 219/757 |
| 2005/0011888 | A1 * | 1/2005 | Kim | 219/757 |
| 2005/0056639 | A1 | 3/2005 | Hu et al. | |
| 2005/0072777 | A1 | 4/2005 | Kim et al. | |
| 2005/0092745 | A1 * | 5/2005 | Yim et al. | 219/757 |
| 2005/0121442 | A1 | 6/2005 | Shin | |
| 2005/0121445 | A1 | 6/2005 | Kang | |
| 2005/0230385 | A1 | 10/2005 | Lee et al. | |

FOREIGN PATENT DOCUMENTS

| | | |
|---|---|---|
| KR | 10-2003-0054964 | 7/2003 |
| KR | 10-2005-0000738 | 1/2005 |
| KR | 10-2005-0030374 | 3/2005 |
| KR | 10-2005-0053946 | 6/2005 |

OTHER PUBLICATIONS

English language Abstract of KR 10-2005-0030374.
English language Abstract of KR 10-2005-0000738.
English language Abstract of KR 10-2005-0053946.
English language Abstract of KR 10-2003-0054964.

* cited by examiner

*Primary Examiner*—Tu B Hoang
*Assistant Examiner*—Hung Nguyen
(74) *Attorney, Agent, or Firm*—McKenna Long & Aldridge LLP

(57) ABSTRACT

A microwave range having a hood for removing contaminated air includes a chamber having an electric component containing electric components, and a fan assembly having at least one vent fan and a cooling fan. The vent fan is driven by a fan motor to generate air current for introducing and exhausting contaminated air, and includes an air outlet through which the contaminated air is exhausted. The cooling fan is driven by the fan motor to generate air current for cooling the electric components, and includes a plurality of air outlets.

18 Claims, 3 Drawing Sheets

MICROWAVE RANGE HAVING HOOD

CROSS REFERENCE TO RELATED APPLICATION

The present disclosure relates to subject matter contained in priority Korean Patent Application No. 2007-0000138, filed Jan. 2, 2007, which is herein expressly incorporated by reference in its entirety.

BACKGROUND

The present disclosure relates to a microwave range, and more particularly, to a microwave range having a hood that exhausts contaminated air generated during a cooking operation of a cooking appliance installed below the microwave range.

A microwave range is a cooking appliance for heating food using microwaves or heat from a heater. An available microwave range includes a hood that purifies contaminated air such as an exhaust gas generated during a cooking operation of a cooking appliance installed below the microwave range and exhausts the purified air to an indoor space or an outdoor space.

However, a related art microwave range having the hood has the following drawbacks.

In order to perform the venting function, the microwave range includes a vent fan for exhausting the contaminated air generated during the cooking operation at the cooking appliance installed below the microwave range and a cooling fan for cooling electric components which generate microwaves. The vent fan and the cooling fan are separately provided, and a separate driving motor is provided for each. This complicates the structure of the microwave range.

Further, since the vent fan for providing the venting function and the cooling fan for cooling the electric components are produced separately, the number of parts required to produce the microwave range having the hood increases. This causes an increase of the manufacturing costs.

SUMMARY

Embodiments provide a microwave range having a hood, which is configured to drive a vent fan and a cooling fan using only one fan motor, thereby having a simplified structure and reduced manufacturing costs.

According to an aspect of the invention, a microwave range having a hood for removing contaminated air includes a chamber having an electric component containing electric components; and a fan assembly having at least one vent fan and a cooling fan, the vent fan being driven by a fan motor to generate air current for introducing and exhausting contaminated air, the vent fan including an air outlet through which the contaminated air is exhausted, the cooling fan being driven by the fan motor to generate air current for cooling the electric components, the cooling fan including a plurality of air outlets.

Air exhausted through one of the air outlets of the cooling fan is directed toward the electric component room to cool the electric components; and the other air outlets of the cooling fan are closed by a shielding member. The shielding member may include a top surface of the chamber; a rear surface of the chamber; and a top inner surface of an outer case located on an upper portion and both sides of the chamber. The shielding member may include a shielding plate or a shielding housing.

The vent fan is installed on the chamber in such a manner that an exhausting direction of the contaminated air through the outlet of the vent fan can be selectively adjusted; and the cooling fan is configured to selectively exhaust air through one of the outlets of the cooling fan toward the electric component room in accordance with an installation direction of the vent fan.

The number of the outlets of the cooling fan is four, one of which is positioned in the same direction as a direction in which the contaminated air is exhausted through the outlet of the vent fan. An extending line extending in a direction in which air is exhausted through the outlets of the vent fan and the cooling fan is located on a plane perpendicular to a rotational shaft of the vent fan and the cooling fan.

According to another aspect of the invention, a microwave range having a hood for removing contaminated air includes an electric component room containing electric components, the electric component room being located at a side of a chamber; a fan motor; first and second vent fans driven by the fan motor to generate air current for introducing and exhausting contaminated air; and a cooling fan coupled to one of the first and second vent fans, the cooling fan being driven by the fan motor to generate air current for cooling the electric components, wherein the first and second vent fans are configured to exhaust the contaminated air in one direction and the cooling fan is configured to exhaust the air in a plurality of directions.

The first and second vent fans are positioned at both sides of the fan motor; and the cooling fan is positioned at an outer side of one of the first and second vent fans.

The first and second vent fans are positioned at both sides of the fan motor to introduce the contaminated air in a lateral direction; a lateral width of an outlet of the first vent fan being wider than that of an outlet of the second vent fan; and the contaminated air that is introduced through an air inlet for venting, which is formed in a base plate located at a lower portion of the chamber, is introduced into the first and second vent fans along passages provided at the lower portion of the chamber and at one side of the chamber.

The first and second vent fans are positioned at both sides of the fan motor to introduce the contaminated air in a lateral direction; a lateral width of an outlet of the first vent fan being wider than that of an outlet of the second vent fan; and the cooling fan is positioned on a side of the second vent fan opposite to the fan motor.

The electric component room is located between the chamber and one side of an outer case located on an upper portion and both sides of the chamber. The cooling fan is located on a rear end of a top surface of a top bracket that extends from one end of a top surface of the chamber toward an inner surface of one side of the outer case, the top bracket forming a top of the electric component room; and the top bracket including a communication opening through which air introduced through an inlet provided on a front surface of the chamber is directed to the electric component room. A demarcation member that divides the flow of air introduced through the inlet for cooling and the flow of air directed to the electric component room through the communication opening is located on a top surface of the top bracket between the inlet for cooling and the communication opening.

The cooling fan includes four air outlets to exhaust the air in four directions, one of which is the same as the direction in which the contaminated air is exhausted by the first and second vent fans; and the one air outlet of the cooling fan, through which the air is directed to the electric component room, and the other air outlets of the cooling fan are selectively closed by a shielding member in accordance with the air exhaustion direction of first and second vent fans. An extending line extending in a direction in which air is exhausted through the outlets of the vent fans and the cooling fan is located on a plane perpendicular to a rotational shaft of the vent fans and the cooling fan. The shielding member includes: a top surface of the chamber; a rear surface of the chamber; and a top inner surface of an outer case installed at an upper portion and both sides of the chamber. The shielding member includes a shielding plate or a shielding housing.

Each of the first and second vent fans has a fan housing and a fan installed in the fan housing, the fans of the first and second vent fans having substantially the same diameter; and a sum of lateral widths of air outlets formed on the fan housings of the first and second vent fans being between 68% to 87% of the diameter of the first and second vent fans.

According to another aspect of the invention, a microwave range having a hood for removing contaminated air includes an air intake passage for venting, along which contaminated air is directed toward first and second vent fans when the first and second vent fans are driven; an air exhaust passage for venting, along which the contaminated air is exhausted to outside by the first and second vent fans; an air intake passage for cooling, along which air for cooling electric components in an electric component room is directed toward a cooling fan when the cooling fan is driven; and an air exhaust passage for cooling, along which air is exhausted to outside after passing through a cooking room provided in a chamber when the cooling fan is driven, wherein the first and second vent fans and the cooling fan are driven by a fan motor, each of the first and second vent fans having one air outlet, and the cooling fan having a plurality of air outlets.

The air intake passage for venting includes: a first air intake passage provided on a lower portion of the chamber; a second air intake passage provided on one side of the chamber and having a lower end communicating with an end of the first air intake passage and an upper end communicating with air inlets of the first and second vent fans.

The air exhaust passage for venting, the air intake passage for cooling, and the air exhaust passage for cooling are located on an upper portion of the chamber and separated by a pair of air guides extending on the top surface of the chamber in a front-rear direction.

An indoor exhaust opening through which the contaminated air is exhausted to an indoor space when the first and second vent fans are driven is provided on a front surface of the chamber that corresponds to a front portion of the air exhaust passage for venting; and an outdoor exhaust opening through which the contaminated air is exhausted to an outdoor space when the first and second vent fans are driven is provided on a top surface of an outer case located on an upper portion and both sides of the chamber, which corresponds to an upper portion of the air exhaust passage for venting.

The air intake passage for cooling is provided on an upper portion of the chamber; and the electric component room is provided at a side of the chamber, which corresponds to a lower portion of the air intake passage for cooling. The electric component room and the intake passage for cooling are separated by a top plate extending from a side of a top surface of the chamber to an inner surface of a side of an outer case located on an upper portion and both sides of the chamber; and the top plate is provided with a communication opening through which the air flowing along the air intake passage for cooling is directed to the electric component room.

A demarcation member for dividing a flow of the air introduced through an inlet for cooling and a flow of air directed to the electric component room through the communication opening is located between the inlet for cooling and the communication opening. The demarcation member is integrally formed with an air guide which separates the air intake passage for venting from the air intake passage for cooling, the air guide being provided on the top surface of the chamber and extending in a front-rear direction.

According to the above embodiments, since the vent fans and the cooling fan are driven by only one common fan motor, the structure of the microwave range can be simplified and the manufacturing cost can be reduced. Further, the space efficiency can be improved.

The details of one or more embodiments are set forth in the accompanying drawings and the description below. Other features will be apparent from the description and drawings, and from the claims.

DETAILED DESCRIPTION OF THE EMBODIMENTS

Reference will now be made in detail to the embodiments of the present disclosure, examples of which are illustrated in the accompanying drawings.

Figure 1:
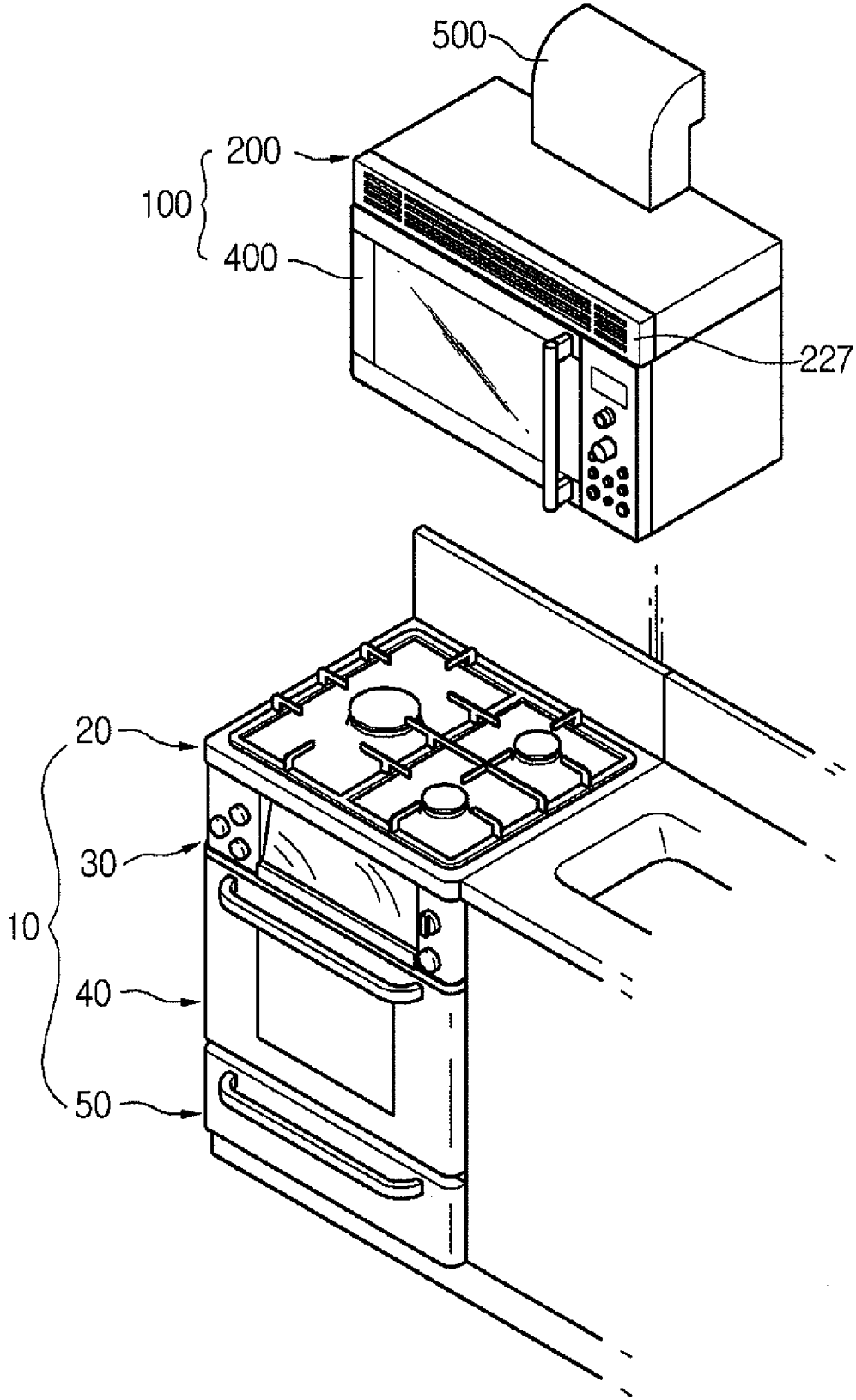
FIG. 1 is a perspective view of a microwave range having a hood according to an embodiment of the present invention.
Figure 2:
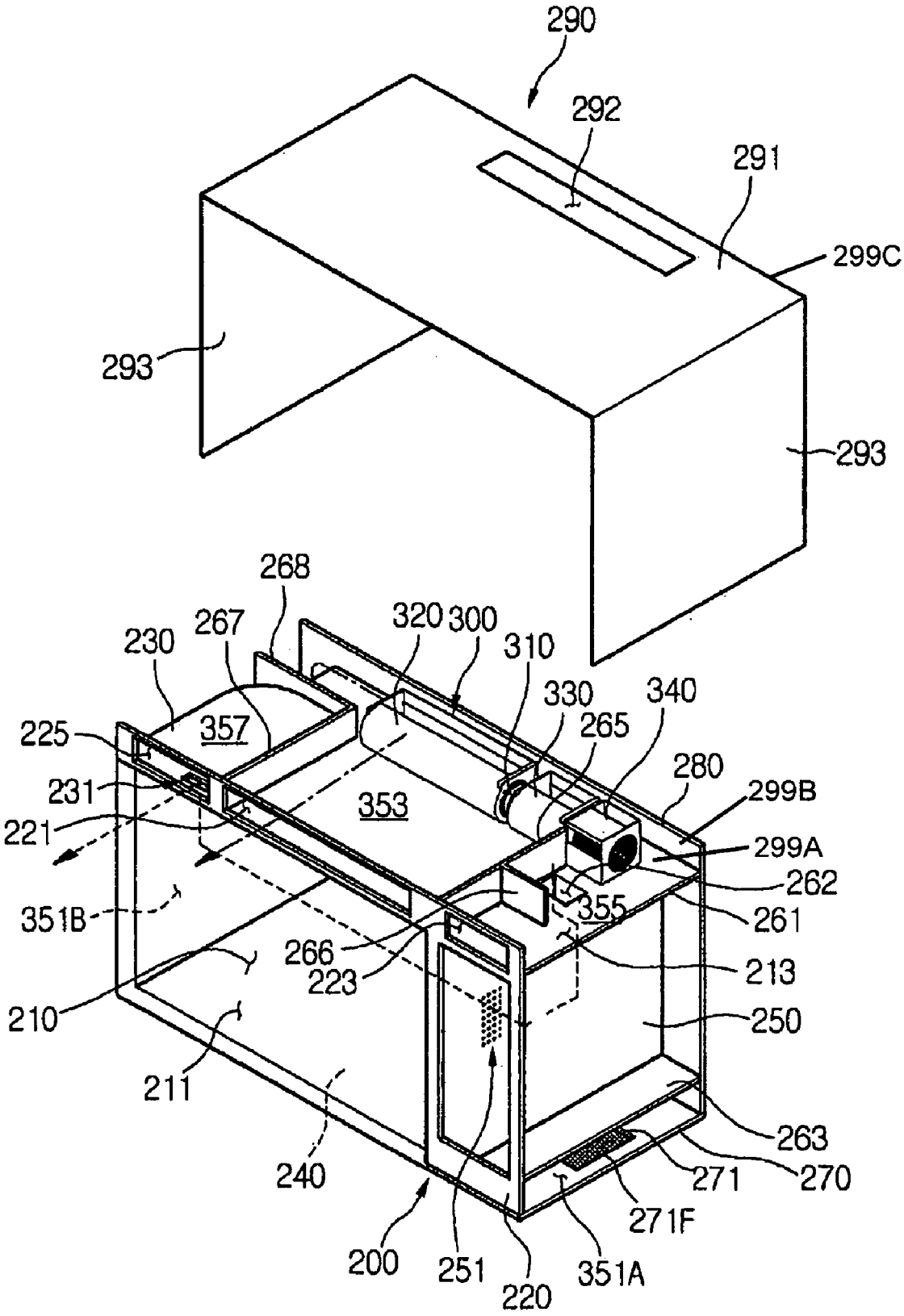
FIG. 2 is an exploded perspective view of the microwave range of FIG. 1.
Figure 3:
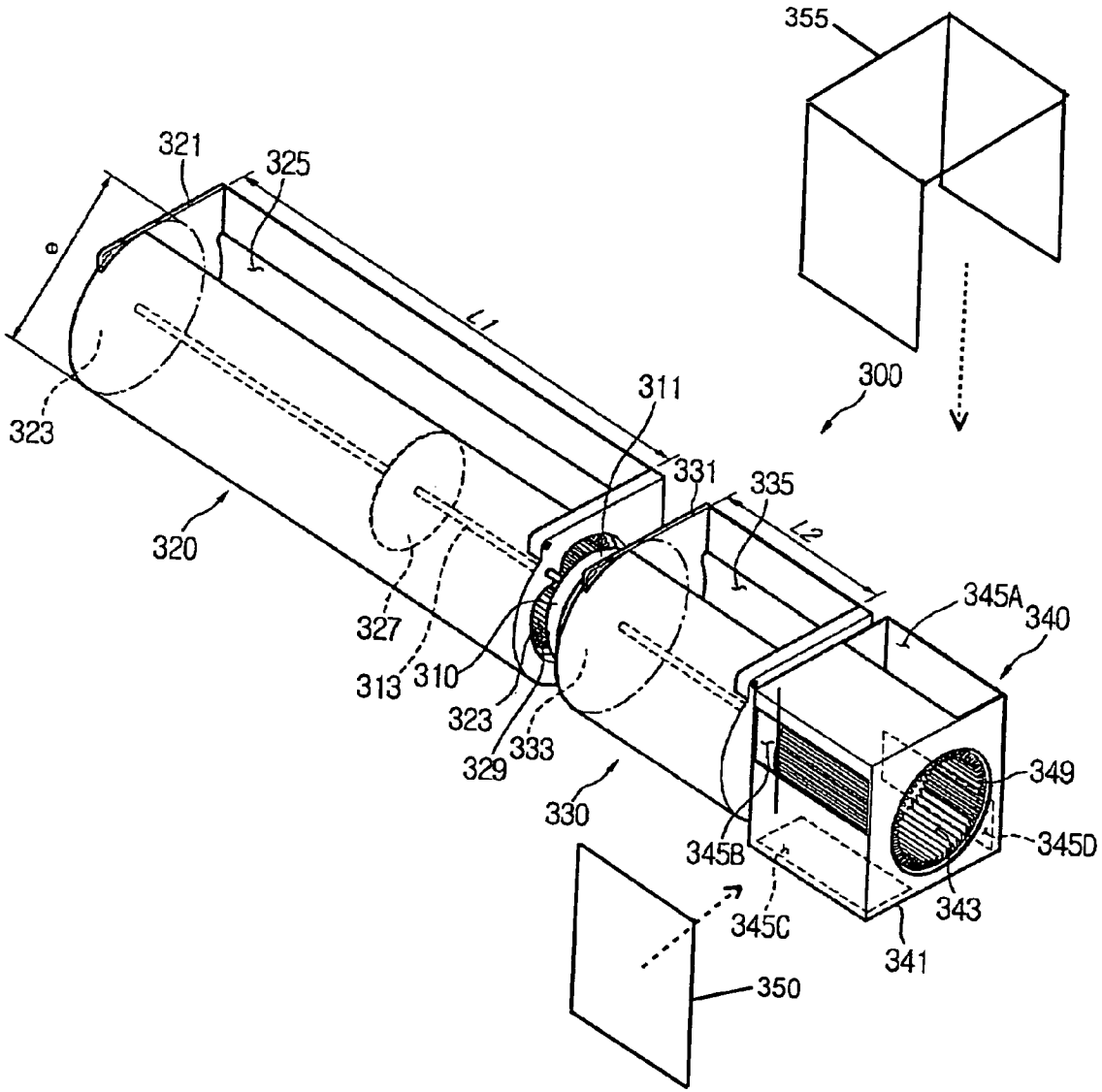
FIG. 3 is a perspective view of a fan assembly of the microwave range of FIG. 2.

FIG. 1 is a perspective view of a microwave range having a hood according to an embodiment of the present invention, FIG. 2 is an exploded perspective view of the microwave range of FIG. 1, FIG. 3 is a perspective view of a fan assembly of the microwave range of FIG. 2.

Referring to FIGS. 1 to 3, a gas oven range 10 is installed in a kitchen. The gas oven range 10 includes a top burner unit 20, a grill unit 30, an oven unit 40, and a drawer unit 50. The top burner unit 20 performs a food cooking operation using combustion of a gas. Also, the grill unit 30, the oven unit 40, and the drawing unit 50 perform a food cooking operation using a heater. Although a gas oven range is shown in FIG. 1, the microwave range according to the present invention can be located above any suitable type of cooking appliance.

A microwave range 100 having a hood (hereinafter, referred to as "microwave range 100") is installed above the gas oven range 10. The microwave range 100 has a function of cooking food using microwaves, and a function of purifying contaminated air including an exhaust gas generated during a cooking operation of the gas oven range 10 and exhausting the purified air to the outside. The microwave range 100 includes a main unit 200 and a door 400. Also, the main unit 200 is provided at an upper surface with an outdoor duct 500 for exhausting contaminated air to the outside.

Referring to FIG. 2, a front plate 220 forms the front side of a chamber 210 of the main unit 200. Also, a top plate 230, a bottom plate 240, a pair of side plates 250, and a rear plate form the upper and lower sides, left and right sides, and rear surface of the chamber 210, respectively.

The front plate 220 is provided at an upper end with an indoor air outlet 221 for a hood, an air inlet 223 for cooling, and an air outlet 225 for cooling. The indoor air outlet 221 for the hood functions to exhaust contaminated air to an indoor space. The air inlet 223 for cooling and the air outlet 225 for cooling introduce and exhaust air for cooling electric components, respectively.

A vent grill 227 (see FIG. 1) is provided on the front upper end of the front plate 220 to correspond to the indoor air outlet 221 for the hood, the air inlet 223 for cooling, and the air outlet 225 for cooling. The vent grill 227 shields the indoor air outlet 221 for the hood, the air inlet 223 for cooling, and the air outlet 225 for cooling, and allows air to be exhausted in a predetermined direction.

One of the side plates 250 and the top plate 230 are respectively provided with a plurality of air intake holes 251 and a plurality of air exhaust holes 231 which allow a cooking chamber 211, an electric component room 213, and exhaust passages 357 for cooling to communicate with each other.

The cooking room 211 is provided inside the chamber 210. The cooking room 211 is a portion where food is heated. The cooking room 211 is selectively opened/closed by the door 400.

Top and bottom brackets 261 and 263 extend rightward from respective upper and lower ends of one of the side plates 250, i.e., the right side plate 250 in this embodiment. At this point, front and rear ends of the top and bottom brackets 261 and 263 closely contact surfaces of the front and back plates 220 and 280. Right ends of the top and bottom brackets 261 and 263 closely contact an inner surface of one of the sides 293 of an outer case 290 that will be described later. The top bracket 261 is provided at a side with a communication opening 262 through which the electric component room 213 communicates with the air intake passage 355.

The top and bottom brackets 261 and 263 form substantially a ceiling and a bottom of the electric component room 213, respectively. That is, the electric component room 213 is formed by the side plate 250, the top and bottom brackets 261 and 263 and a side 293 of the outer case 290. A variety of electric components generating microwaves, such as magnetrons, a high voltage capacitor, a high voltage transformer, and the like are installed in the electric component room 213.

A pair of air guides 265 and 267 is provided on the top plate 230. The air guides 265 and 267 extend in a front-rear direction on the top plate 230. The air guides 265 and 267 divide a passage formed between the top plate 230 and a top 291 of the outer case 290 into an air intake passage 355 for cooling and an air exhaust passage 357 for cooling. The air guides 265 and 267 are respectively located on portions of the top surface of the top plate 230, which correspond respectively to a portion between the air outlet 221 for the hood and the air inlet 223 for cooling and a portion between the air outlet 221 for the hood and the air outlet 225 for cooling. Front ends of the air guides 265 and 267 closely contact one surface of the front plate 220 and rear ends of the air guides 265 and 267 are spaced apart from the surface of the back plate 280. This configuration provides space for installing a fan assembly 300 that will be described later. The air guides 265 and 267 will be respectively referred to as first and second air guides. In this embodiment, the first air guide 265 is substantially provided on a boundary portion between the top plate 230 and the top bracket 261.

A demarcation member 266 is provided on the first air guide 265 between the air inlet 223 for cooling and the communication opening 262. The demarcation member 266 prevents the air flowing directly into the air intake passage 355 for cooling through the air inlet 223 for cooling from entering directly into the communication opening 262 with the air flowing from the air intake passage 355 for cooling to the electric component room 213. The demarcation member 266 may be integrally formed with the first air guide 265.

A demarcation rib 268 is provided on the second air guide 267. The demarcation rib 268 extends from the rear end of the second air guide 267 toward the air exhaust passage 357 for cooling, i.e., leftward in the drawing. The demarcation rib 268 functions to separate the air exhaust passage 357 for cooling from a second air intake passage 351B that will be described later.

A base plate 270 is installed at a lower portion of the chamber 210. The base plate 270 forms substantially an outer appearance of the bottom of the main unit 200. The base plate 270 is formed on the lower portion of the chamber 210 such that a top surface thereof is spaced apart from a bottom surface of the bottom plate 240. Therefore, a predetermined space is formed between the bottom plate 240 and the base plate 270 and a first air intake passage 351A for the hood is provided in the predetermined space.

The base plate 270 is provided with an air inlet 271 for the hood. The air inlet 271 for the hood is formed by cutting a portion of the base plate 270 in a predetermined shape. The air inlets may be of any suitable shape, such as a rectangular shape extending in a horizontal direction. The air inlet 271 for the hood functions as an inlet through which the contaminated air is introduced. A filter 271F is provided in the air inlet 271 for the hood. The filter 271F filters off foreign matter contained in the contaminated air introduced through the air inlet 271 for the hood to purify the contaminated air.

The back plate 280 is installed on a rear end of the chamber 210. The back plate 280 forms an outer appearance of the rear surface of the main body 200. The back plate 280 has a front surface closely contacting the rear plate of chamber 210. That is, a space for forming a passage is not formed between the rear plate and the back plate 280.

An outer case 290 is installed at an upper portion and both sides of the chamber. The outer case 290 substantially includes a top 291 forming the top appearance of the main unit 200, and two side surfaces 293 forming both side appearances of the main unit 200. The top surface 291 and both side surfaces 293 of the outer case 290 are separated vertically and horizontally by a predetermined distance from the top plate 230 and the side plates 250, respectively. Also, an outdoor air outlet 292 for the hood is formed at the rear end on the top surface 291 of the outer case 290. The outdoor air outlet 292 for the hood is configured to exhaust the contaminated air to the outside through the outdoor duct 500.

A fan assembly 300 is installed on a rear end of the top surface of the chamber 210. The fan assembly 300 is provided for a hood function and providing driving force for cooling the electric components. The fan assembly 300 includes a fan motor 310, a pair of vent fans 320 and 330, and a cooling fan 340. With the fan assembly 300 installed on the rear end of the chamber 210, the vent fans 320 and 330 and the fan motor 310 are located at a rear end of the air exhaust passage 353 for the hood, which corresponds to a portion directly under the outdoor outlet for the hood. The cooling fan 340 is located at a rear end of the air intake passage 355 for cooling when the fan assembly 300 is installed at the rear end of the chamber 210.

Referring to FIG. 3, the fan motor 310 includes a motor housing 311 forming an appearance of the fan motor 310, and a stator (not shown) and a rotor (not shown) that are installed in the motor housing 311. A motor shaft 313 provided on the rotor extends out of both sides of the motor housing 311.

The vent fans 320 and 330 are provided on both side ends of the fan motor 310. The vent fans 320, 330 include fan housings 321, 331 forming the outer appearance of the vent fans 320, 330. The vent fans 320, 330 may be formed in any suitable shape, such as a polygonal body having a semi-oval shaped cross-section. The fan housings 321 and 331 of the respective vent fans 320 and 330 are fixed on both sides of the motor housing 311, respectively.

The left and right vent fans 320 and 330 in FIG. 3 will be referred to as first and second vent fans, respectively. The fan housing 321 of the vent fan 320 is provided at both ends with air inlets 323. The fan housing 331 of the second vent fan 330 is provided at an end near the fan motor 310 with an air inlet 333. The air inlets 323 and 333 of the first and second vent fans 320 and 330 function as inlets through which the contaminated air flowing along the air intake passages 351A and 351B is introduced. The air inlet 323 of the first vent fan 320, provided at the end near the fan motor 310, and the air inlet 333 of the second vent fan 330 function as inlets through which contaminated air cools the fan motor 310. The contaminated air for cooling the fan motor 310 is introduced through the air inlet 323 of the first vent fan 320, provided at the end near the fan motor 310 and the air inlet 333 of the second vent fan 330 along passage (not shown) provided below the fan assembly 300. The passage is provided between the top plate 230 and the fan assembly 300 or between the top plate 230 and a plate (not shown) forming a ceiling of the cooking chamber 211. Air outlets 325 and 335 are formed in surfaces of the fan housings 321 and 331 of the first and second vent fans 320 and 330, which are perpendicular to the air inlets 323 and 333 of the first and second vent fans 320 and 330. The air outlets 325 and 335 of the first and second vent fans 320 and 330 function to exhaust the contaminated air introduced through the air inlets 323 and 333 of the first and second vent fans 320 and 330 to the air exhaust passage 353. The front surface of the fan housing 321 of the first vent fan 320 is spaced apart from the rear end of the second air guide 267 and the demarcation rib 268 so that the contaminated air can be effectively introduced through the air inlets 323 and 333 of the first and second vent fans 320 and 330.

As shown in FIG. 2, in a state where the fan assembly 300 is installed on the top surface of the chamber 210, the air inlets 323 and 333 of the first and second vent fans 320 and 330 face the side surfaces of the chamber 210. The outlets 325 and 335 of the first and second vent fans 320 and 330 can be installed to face a front portion of the chamber 210 (i.e., the indoor outlet 221 for the hood) or can be adjusted to a position in which they face an upper portion of the chamber 210 (i.e., the outdoor outlet 292 for the hood). That is, the contaminated air is selectively exhausted to the indoor space or the outdoor space through the outlets 325 and 335 of the first and second vent fans 320 and 330.

In this embodiment, a left-right lateral width L1 of the outlet 325 of the first vent fan 320 and the left-right lateral width L2 of the outlet 335 of the second vent fan 330 are different from each other. In more detail, the left-right lateral width L1 of the outlet 325 of the first vent fan 320 is wider than the left-right lateral width L2 of the outlet 335 of the second vent fan 330. At this point, the relative ratio of the widths L1 and L2 is not limited to a specific range. The sum of the widths L1 and L2 may range from 68% to 87% of a diameter Φ of the first and second vent fans 320 and 330. This design range is obtained through a test. When the sum of the widths L1 and L2 ranges from 68% to 87% of a diameter Φ of the first and second vent fans 320 and 330, the efficiency of the first and second vent fans 320 and 330 becomes maximized.

A rotational plate 327 and a fan 329 are provided in each of the fan housings 321 and 331 of the first and second vent fans 320 and 330. The rotational plates 327 of the first and second vent fans 320 and 330 are coupled to the motor shaft 313 and the fans 329 of the first and second vent fans 320 and 330 are coupled to the rotational plates 327 of the first and second vent fans 320 and 330. Therefore, when the motor shaft 313 rotates, the fans 329 of the first and second vent fans 320 and 330 rotates to introduce and exhaust the contaminated air.

The cooling fan 340 is fixed on an outer end of the fan housing 331 of the second vent fan 330, which is furthest from the fan motor 310. The cooling fan 340 includes a fan housing 341 forming an appearance of the cooling fan 340. The fan housing 341 of the cooling fan 340 is substantially fixed on the fan housing 331 of the second vent fan 330. The fan housing 341 of the cooling fan 340 may be formed in any suitable shape, such as a hexahedron shape in which the fan housings 321 and 331 of the first and second vent fans 320 and 330 are circumscribed. One surface of the fan housing 341 of the cooling fan 340 is located on a same plan as the surface on which the outlets 325 and 335 of the first and second vent fans 320 and 330 are formed.

An air inlet 343 is formed on an outer end of the fan housing 341 of the cooling fan 340, which is furthest from the second vent fan 330. The air inlet 343 of the cooling fan 340 functions to introduce air flowing along the air intake passage 355 for cooling.

Air outlets 345A, 345B, 345C, and 345D are formed on four sides of the fan housing 341 of the cooling fan 340, which are perpendicular to the air inlet 343 of the cooling fan 340. The air outlets 345A, 345B, 345C, and 345D of the cooling fan 340 function to exhaust the air introduced through the air inlet 343 of the cooling fan 340 to the electric component room 213. One of the air outlets 345A, 345B, 345C, and 345D may be formed to exhaust the air introduced through the air inlet 343 in a direction in which the air is exhausted through the outlets 325 and 335 of the cooling fan 340. Therefore, the air outlets 345A, 345B, 345C, and 345D of the cooling fan 340 exhaust the air at an angle of 0°, 90°, 180°, and 270° in a clockwise or counterclockwise direction with respect to the outlets 325 and 335 of the first and second vent fans 320 and 330. The outlet 345A that exhausts air at an angle of 0° that is a direction in which the air is exhausted through the outlets 325 and 335 of the first and second vent fans 320 and 330 will be referred to as a first outlet. Further, the air outlets 345B, 345C, and 345D of the cooling fan 340, which exhaust the air at an angle of 0°, 90°, 180°, and 270° in a clockwise or counterclockwise direction with respect to the outlets 325 and 335 of the first and second vent fans 320 and 330, will be referred to as second, third, and fourth outlets. Further, except for one of the first, second, third, and fourth outlets 345A, 345B, 345C, and 345D, the outlets are closed by the top plate 230, the back plate 280, and the top 291 of the outer case 290, allowing an air exhaust direction through the outlets 325 and 335 of the first and second vent fans 320 and 330 to vary. Therefore, the air exhaust through one of the first, second, third, and fourth outlets 345A, 345B, 345C, and 345D is directed toward the electric component room 213 regardless of the air exhaust direction through the air outlets 325 and 335 of the first and second vent fans 320 and 330.

A rotational plate (not shown) is provided in the fan housing 341 of the cooling fan 340. The rotational plate of the cooling fan 340 is coupled to the motor shaft 313 to rotate by the rotation of the motor shaft 313. A fan 349 is coupled to the rotational plate of the cooling fan 340. Therefore, by the rotation of the rotational plate of the cooling fan 340, the fan 349 of the cooling fan 340 rotates and thus the air introduced through the air inlet 343 of the cooling fan 340 is exhausted through one of the first, second, third, and fourth outlets 345A, 345B, 345C, and 345D of the cooling fan 340.

Referring to FIG. 2, the chamber 210 is provided with a plurality of passages, i.e., intake passages 351A and 351B for the hood, an exhaust passage 353 for the hood, an intake passage 355 for cooling, and an exhaust passage 357 for cooling. The contaminated air flows along the intake passages 351A and 351B for the hood and the exhaust passage 353 for the hood. The air for cooling the electric components flows along the intake passage 353 for cooling and the exhaust passage 357 for cooling.

The intake passages 351A and 351B for the hood will be referred to as first and second intake passages, respectively. The first intake passage 351A is provided on a bottom of the chamber 210 between the bottom plate 240 and the base plate 270 and the sides 293 of the outer case 290. The contaminate air introduced through the air inlet 271 for the hood flows along the first intake passage 351A for the hood. The second intake passage 351B is formed on a side surface of the chamber 210 between the left side plate 250 and one of the sides 293 of the outer case 290. A lower end of the second intake passage 351B communicates with an end of the first intake passage 351A. An upper end of the second intake passage 351B communicates with inlets 323 and 333 of the first and second vent fans 320 and 330. The contaminated air flowing along the first intake passage 351A flows toward the inlets 323 and 333 of the first and second vent fans 320 and 330 along the second intake passage 351B.

The exhaust passage 353 is provided on the top surface of the chamber 210 between the first and second air guides 265 and 267, i.e., between the top plate 230 and the top 291 of the outer case 290. The contaminated air exhausted through the outlets 325 and 335 of the first and second vent fans 320 and 330 flows along the exhaust passage 353 for the hood.

The intake passage 355 for cooling is provided between the top bracket 261 and the top surface 291 of the outer case 290, i.e., between the first air guide 265 and one of the side surfaces 293 of the outer case 290. The air introduced through the inlet 223 for cooling flows along the intake passage 355 for cooling.

The air that passes through the cooking chamber 211 after cooling the electric components flows along the exhaust passage 357 for cooling. To realize this, the air exhaust holes 231 are formed on a side of the top plate 230, which corresponds to an inside of the exhaust passage 357 for cooling.

An operation of a microwave range having a hood will be described below according to an embodiment of the present disclosure.

First, a process of circulating contaminated air will be described below according to the microwave range having the hood in an embodiment of the present disclosure.

When a user operates the microwave range, the first and second vent fans 320 and 330 are driven. When the first and second vent fans 320 and 330 are driven, contaminated air including an exhaust gas generated during a cooking operation of the gas oven range 10 is introduced through the air inlet 271 for the hood to flow along the first air intake passage 351A, in the course of which the foreign matter contained in the contaminated air is filtered off by the filter 271F.

Meanwhile, the air flowing along the first air intake passage 351A for the hood flows along the second air intake passage 351B by the driving of the first and second vent fans 320 and 330 and is introduced through the air inlets 323 and 333 of the first and second vent fans 320 and 330. The air introduced through the air inlet 323 of the first vent fan 320, provided at the end near the fan motor 310 of the fan housing 331 of the first vent fan 320 and the air inlet 333 of the second vent fan 330 is used to cool the fan motor 310. Also, air introduced through the air inlets 323 and 333 of the first and second vent fans 320 and 330 is exhausted through the air outlets 325 and 335 of the first and second vent fans 320 and 330.

Air exhausted through the air outlets 325 and 335 of the first and second vent fans 320 and 330 flows along the air exhaust passage 353 for the hood, and is exhausted to an indoor space through the indoor air outlet 221 for the hood and the vent grill 227. Needless to say, when the air outlets 325 and 335 of the first and second vent fans 320 and 330 of the fan assembly 300 are positioned toward the outdoor air outlet 292 for the hood, the air exhausted through the air outlets 325 and 335 of the first and second vent fans 320 and 330 will be exhausted to the outdoor space through the outdoor air outlet 292 for the hood and the outdoor duct 500 (see FIGS. 1 and 2).

Next, a process of circulating air for cooling the electric components will be described according to an embodiment of the present disclosure.

As described above, when the fan motor 310 is driven to drive the first and second vent fans 320 and 330, the cooling fan 340 operates. When the cooling fan 340 operates, air introduced through the air inlet 223 for cooling flows along the air intake passage 355 for cooling.

The air flowing along the air intake passage 355 for cooling is introduced to the air inlet 343 of the cooling fan 340 and subsequently exhausted through the first, second, third, and fourth air outlets 345A, 345B, 345C, and 345D of the cooling fan 340. However, three of the first, second, third, and fourth air outlets 345A, 345B, 345C, and 345D, that is, the second, third, and fourth air outlets 345B, 345C, and 345D in FIG. 3 are closed by the top plate 230, the back plate 280, and the top surface 291 of the outer case 290. Therefore, the air introduced through the air inlet 343 of the cooling fan 340 is exhausted through the first air outlet 345A of the cooling fan 340.

As described above, when the first and second vent fans 320 and 330 are installed to exhaust air toward the outdoor air outlet 292 for the hood, the first air outlet 345A of the cooling fan 340 is closed by the top surface 291 of the outer case 290. The third and fourth air outlets 345C and 345D of the cooling fan 340 are respectively closed by the top plate 230 and the back plate 280. Therefore, the air introduced through the air inlet 343 of the cooling fan 340 will be exhausted frontward through the second air outlet 345B of the cooling fan 340.

The air exhausted through the first outlet 345A of the cooling fan 340 is directed to the electric component room 213 through the communication opening 262. At this point, the air flowing along the air intake passage 355 for cooling, i.e., the air introduced through the air inlet 343 of the cooling fan 340, and the air exhausted through the first air outlet 345A of the cooling fan and directed to the electric component room 213 through the communication opening 262 are divided by the demarcation member 266. That is, the air exhausted through the first air outlet 345A of the cooling fan 340 flows frontward and changes its flowing direction downward, i.e., toward the communication opening 262.

The air directed to the electric component room 213 through the communication opening 262 is used to cool the electric components. The air used for cooling the electric components is directed into the cooking chamber 211 through the air intake holes 251 by the continuous operation of the cooling fan 340.

The air directed into the cooking chamber 211 circulates through the inside of the cooking chamber 211, in the course of which a variety of foreign matter generated during the cooking operation of the food are mixed with the air.

The air circulating through the cooking chamber 211 is directed to the air exhaust passage 357 through the air exhaust holes 231. The air directed to the air exhaust passage 357 is exhausted to the indoor space through the air outlet 225 for cooling and the vent grill 227.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

For example, in the embodiments of the present invention, except for a forward facing one of the first, second, third, and fourth outlets, the outlets are closed by the top plate, the back plate, and the top of the outer case (shielding members 299A-C). However, the present invention is not limited to this embodiment. That is, except for a forward facing one of the first, second, third, and fourth outlets, the outlets may be closed by a plurality of separate shielding plates 350. Alternatively, the outlets may be closed by a shielding housing 355 enclosing three sides of the cooling fan.

As described above, according to the microwave range of the present invention, a pair of vent fans for the hood function and a cooling fan for cooling are driven by a common fan motor. That is, one of the driving motors may be eliminated. Therefore, the number of components of the microwave range is reduced and the structure is simplified.

Further, the reduction in the number of the components reduces the manufacturing costs and the number of manufacturing steps.

Furthermore, the reduction in the number of the components increases an internal space of the microwave range. Therefore, the volume of the cooking chamber can be relatively increased.

The foregoing embodiments and advantages are merely exemplary and are not to be construed as limiting the present invention. The present teaching can be readily applied to other types of apparatuses. The description of the present invention is intended to be illustrative, and not to limit the scope of the claims. Many alternatives, modifications, and variations will be apparent to those skilled in the art.

The illustrations of the embodiments described herein are intended to provide a general understanding of the structure of the various embodiments. The illustrations are not intended to serve as a complete description of all of the elements and features of apparatus and systems that utilize the structures or methods described herein. Many other embodiments may be apparent to those of skill in the art upon reviewing the disclosure. Other embodiments may be utilized and derived from the disclosure, such that structural and logical substitutions and changes may be made without departing from the scope of the disclosure. Accordingly, the disclosure and the figures are to be regarded as illustrative rather than restrictive.

One or more embodiments of the disclosure may be referred to herein, individually and/or collectively, by the term "invention" merely for convenience and without intending to voluntarily limit the scope of this application to any particular invention or inventive concept. Moreover, although specific embodiments have been illustrated and described herein, it should be appreciated that any subsequent arrangement designed to achieve the same or similar purpose may be substituted for the specific embodiments shown. This disclosure is intended to cover any and all subsequent adaptations or variations of various embodiments. Combinations of the above embodiments, and other embodiments not specifically described herein, will be apparent to those of skill in the art upon reviewing the description.

The above disclosed subject matter is to be considered illustrative, and not restrictive, and the appended claims are intended to cover all such modifications, enhancements, and other embodiments which fall within the true spirit and scope of the present invention. Thus, to the maximum extent allowed by law, the scope of the present invention is to be determined by the broadest permissible interpretation of the following claims and their equivalents, and shall not be restricted or limited by the foregoing detailed description.

Although the invention has been described with reference to several exemplary embodiments, it is understood that the words that have been used are words of description and illustration, rather than words of limitation. As the present invention may be embodied in several forms without departing from the spirit or essential characteristics thereof, it should also be understood that the above-described embodiments are not limited by any of the details of the foregoing description, unless otherwise specified. Rather, the above-described embodiments should be construed broadly within the spirit and scope of the present invention as defined in the appended claims. Therefore, changes may be made within the metes and bounds of the appended claims, as presently stated and as amended, without departing from the scope and spirit of the invention in its aspects.

What is claimed is:

1. A microwave range having a hood for removing contaminated air, the microwave range comprising:

a chamber having an electric component room containing electric components; and a fan assembly having at least one vent fan and a cooling fan, the vent fan being driven by a fan motor to generate an air current for introducing and exhausting contaminated air, the vent fan including an air outlet through which the contaminated air is exhausted, the cooling fan being driven by the fan motor to generate an air current for cooling the electric components, the cooling fan including a plurality of air outlets, wherein each of the vent fan and the cooling fan comprise a fan housing and a fan installed in the fan housing, the fan housing of the vent fan and the fan housing of the cooling fan are fixed to each other, and one of the plurality of air outlets of the cooling fan is opened, and other air outlets of the cooling fan are closed by a shielding member, wherein the shielding member includes a shielding plate and shielding housing, the shielding plate and shielding housing configured to close the other air outlets of the cooling fan, the shielding housing having a top side surface and two opposing side surfaces connected to the top side surface.

2. The microwave range according to claim 1, wherein air exhausted through one of the air outlets of the cooling fan is directed toward the electric component room to cool the electric components.

3. The microwave range according to claim 1, wherein the vent fan is installed on the chamber in such a manner that an exhausting direction of the contaminated air through the outlet of the vent fan can be selectively adjusted; and the cooling fan is configured to selectively exhaust air through one of the outlets of the cooling fan toward the electric component room in accordance with an installation direction of the vent fan.

4. The microwave range according to claim 1, wherein the number of the outlets of the cooling fan is four, one of which is positioned in the same direction as a direction in which the contaminated air is exhausted through the outlet of the vent fan.

5. The microwave range according to claim 4, wherein an extending line extending in a direction in which air is exhausted through the outlets of the vent fan and the cooling fan is located on a plane perpendicular to a rotational shaft of the vent fan and the cooling fan.

6. A microwave range having a hood for removing contaminated air, the microwave range comprising:

an electric component room containing electric components, the electric component room being located at a side of a chamber;

a fan motor;

first and second vent fans driven by the fan motor to generate an air current for introducing and exhausting contaminated air; and a cooling fan coupled to one of the first and second vent fans, the cooling fan being driven by the fan motor to generate an air current for cooling the electric components, the cooling fan including a plurality of air outlets, wherein each of the first and second vent fans and the cooling fan comprise a fan housing and a fan installed in the fan housing, the fan housings are fixed to each other, the first and second vent fans are installed on the chamber in such a manner that a direction of exhaust of the contaminated air through the outlets of the first and second vent fans can be selectively adjusted, and the cooling fan is configured to exhaust air through one of the plurality of outlets of the cooling fan in a direction toward the electric component room regardless of the direction of exhaust of the first and second vent fans, wherein the shielding member includes a shielding plate and shielding housing, the shielding plate and shielding housing configured to close the plurality of the air outlets of the cooling fan except one of the air outlets of the cooling fan, the shielding housing having a top side surface and two opposing side surfaces connected to the top side surface.

7. The microwave range according to claim 6, wherein the first and second vent fans are positioned at both sides of the fan motor; and the cooling fan is positioned at an outer side of one of the first and second vent fans.

8. The microwave range according to claim 6, wherein the first and second vent fans are positioned at both sides of the fan motor to introduce the contaminated air in a lateral direction;

a lateral width of an outlet of the first vent fan being wider than that of an outlet of the second vent fan; and the contaminated air that is introduced through an air inlet for venting, which is formed in a base plate located at a lower portion of the chamber, is introduced into the first and second vent fans along passages provided at the lower portion of the chamber and at one side of the chamber.

9. The microwave range according to claim 6, wherein the first and second vent fans are positioned at both sides of the fan motor to introduce the contaminated air in a lateral direction;

a lateral width of an outlet of the first vent fan being wider than that of an outlet of the second vent fan; and the cooling fan is positioned on a side of the second vent fan opposite to the fan motor.

10. The microwave range according to claim 6, wherein the electric component room is located between the chamber and one side of an outer case located on an upper portion and both sides of the chamber.

11. The microwave range according to claim 10, wherein the cooling fan is located on a rear end of a top surface of a top bracket that extends from one end of a top surface of the chamber toward an inner surface of one side of the outer case, the top bracket forming a top of the electric component room; and the top bracket including a communication opening through which air introduced through an inlet provided on a front surface of the chamber is directed to the electric component room.

12. The microwave range according to claim 11, wherein a demarcation member that divides the flow of air introduced through the inlet for cooling and the flow of air directed to the electric component room through the communication opening is located on a top surface of the top bracket between the inlet for cooling and the communication opening.

13. The microwave range according to claim 6, wherein the cooling fan includes four air outlets to exhaust the air in four directions, one of which is the same as the direction in which the contaminated air is exhausted by the first and second vent fans; and the one air outlet of the cooling fan, through which the air is directed to the electric component room, and the other air outlets of the cooling fan are selectively closed by the shielding member in accordance with the air exhaustion direction of first and second vent fans.

14. The microwave range according to claim 13, wherein an extending line extending in a direction in which air is exhausted through the outlets of the vent fans and the cooling fan is located on a plane perpendicular to a rotational shaft of the vent fans and the cooling fan.

15. The microwave range according to claim 6, wherein each of the first and second vent fans has a fan housing and a fan installed in the fan housing, the fans of the first and second vent fans having substantially the same diameter; and a sum of lateral widths of air outlets formed on the fan housings of the first and second vent fans being between 68% to 87% of the diameter of the first and second vent fans.

16. A microwave range having a hood for removing contaminated air, the microwave range comprising:

an electric component room containing electric components, the electric component room being located at a side of a chamber;

a fan motor;

first and second vent fans driven by the fan motor to generate an air current for introducing and exhausting contaminated air, each of the first and second vent fans comprising a fan housing provided with an air outlet and a fan installed in the fan housing;

a cooling fan coupled to one of the first and second vent fans, the cooling fan being driven by the fan motor to generate an air current for cooling the electric components, the cooling fan including a fan housing provided with a plurality of air outlets and a fan installed in the fan housing; and a shielding member including a shielding plate and shielding housing closing the plurality of the air outlets of the cooling fan except one of the air outlets of the cooling fan, the shielding housing having a top side surface and two opposing side surfaces connected to the top side surface, wherein the first and second vent fans are installed on the chamber in such a manner that a direction of exhaust of the contaminated air through the outlet of the first and second vent fans can be selectively adjusted, and the cooling fan is configured to exhaust air through one of the plurality of outlets of the cooling fan in a direction toward the electric component room regardless of the direction of exhaust of the first and second vent fans.

17. The microwave range according to claim 16, wherein the number of the outlets of the cooling fan is four, and air exhausted through three air outlets of the cooling fan are exhausted at an angle of 90°, 180°, and 270° with respect to an air exhausted through other air outlet of the cooling fan, respectively.

18. The microwave range according to claim 16, wherein the fan housing of the cooling fan is formed a hexahedron, and the air outlets of the cooling fan are positioned at four surfaces except two surfaces opposite each other.

* * * * *